US005920982A

United States Patent [19]

Fudoo

[11] Patent Number: 5,920,982

[45] Date of Patent: Jul. 13, 1999

[54] TERMINAL CRIMPING APPARATUS

[75] Inventor: Eiji Fudoo, Yokkaichi, Japan

[73] Assignee: Sumitomo Wiring Systems, Ltd., Japan

[21] Appl. No.: 08/859,638

[22] Filed: May 20, 1997

Related U.S. Application Data

[62] Division of application No. 08/445,423, May 19, 1995, Pat. No. 5,685,067.

[30] Foreign Application Priority Data

Jun. 13, 1994 [JP] Japan ..... 6-130526

[51] Int. Cl.[6] ..... H01R 43/048

[52] U.S. Cl. ..... 29/753; 29/755; 29/863

[58] Field of Search ..... 29/33 M, 753, 29/755, 863, 866; 72/412, 712

[56] References Cited

U.S. PATENT DOCUMENTS 5,375,317 12/1994 Murakami et al. ..... 29/753
5,390,410 2/1995 Takenami et al. ..... 29/753
5,432,995 7/1995 Takenami et al. ..... 29/863 X

FOREIGN PATENT DOCUMENTS 592253 4/1994 European Pat. Off. ..... 29/753

*Primary Examiner*—Peter Vo
*Attorney, Agent, or Firm*—Jordan B. Bierman; Bierman, Muserlian and Lucas

[57] ABSTRACT

A crimp terminal is supplied to a predetermined crimping position. Into the barrel of the supplied terminal, the wire end of an insulated conductor is inserted. At that time, the cable conductor end is aligned in the desired proper position for crimping. Even when the cable conductor end is deformed or broken in the stripping or supply processes, all the cable conductor ends can be reliably accommodated in the barrel of the terminal. Accordingly, it is possible to prevent crimping defects caused by exclusion from the terminal of one or more wire ends.

2 Claims, 13 Drawing Sheets

TERMINAL CRIMPING APPARATUS

This application is a division of application Ser. No. 08/445,423 filed May 19, 1995, now U.S. Pat. No. 5,685, 067.

This Application claims the priority of Japanese Application 6-130526, filed Jun. 13, 1994.

The present invention relates to a terminal crimping method and apparatus; more particularly, to a terminal crimping method and terminal crimping apparatus particularly suited for supplying at least one end of an insulated conductor to a terminal accommodated in a connector housing and crimping the terminal around the end.

BACKGROUND OF THE INVENTION

Open barrel terminals, crimped to the end of an insulated conductor, have been known for use in electric wiring systems such as wire harnesses. Referring to FIG. 13, which is a schematic perspective view, open barrel crimp terminal 2 has wire barrel 21, which is to be crimped to wire end 41A of conductor 4, and insulation barrel 22, which is to be crimped to insulation end 41B. It comprises common barrel 21A of substantially semi-circular cross-section and a pair of wire claws 21C projecting therefrom. With wire end 4 1A and insulation end 42 accommodated in wire barrel 21 and insulation barrel 22, respectively, wire claws 21C and insulation claws 22C are crimped to a predetermined shape, thereby fixing crimp terminal 2 to conductor 4.

Referring to FIG. 14, which is a schematic section of a conventional terminal crimping apparatus, and FIG. 15, which is an enlarged view of its essential part, the prior art device, as disclosed for example in Japanese Patent Laid-open Publication No. 104577/1986, comprises anvil A fixed to frame 71, crimper C for crimping terminal 2 in cooperation with anvil A, sliding member 72 for driving crimper C toward and away from anvil A, and carrying hand 73 for carrying conductor 4. In the crimping process, common barrel 21A of terminal 2 is placed on anvil A in advance, and conductor end 41 with exposed wire end 41A is inserted into barrel 21A by carrying hand 73. Thereafter, wire claws 21C and insulation claws 22C of terminal 2 are crimped by crimper C, by which wire barrel 21 is fixed to wire end 41A and insulation barrel 22 is fixed to insulation end 41B.

What has been required in recent years in the terminal crimping apparatus as described above is to carry insulated conductor 4 automatically to terminal 2 on anvil A and to have anvil A and crimper C carry out a reliable crimping operation. However, according to the conventional devices, complete elimination of crimping defects has not been possible.

For example, conventional carrying hand 73 only supports the intermediate part of conductor 4 when it carries wire end 41A to crimped terminal 2; thus, if wire end 41A has been bent or torn, loose end 407 may be excluded from crimped terminal 2. This is caused by displacement of crimp terminal 2 on anvil A from the desired supply receiving position. Further, before crimping, wire claws 21C are spread toward crimper C at a predetermined angle. However, as shown in FIGS. 13 and 14, even slight deformation of claws 21C, excludes loose wire end 407. Also, a crimping defect occurs when crimp terminal 2 rolls during the crimping process. In such a case, as shown in FIG. 16, claws 21C and 22C butt against the recess of crimper C (see FIG. 16 (B)), thereby making it impossible to reliably crimp claws 21C and 22C.

Owing to a large number of causes, crimping defects are likely to occur. This has been a bottleneck for automation; especially in the case of crimping this type of terminal accommodated in a connector housing to an insulated conductor. The range in which the covered conductor 4 can be clamped is extremely restricted, so that failures as described above occur.

SUMMARY OF THE INVENTION

The present invention is intended to solve the problems mentioned above, and its object is to provide a terminal crimping method and apparatus with which it is possible to prevent exclusion of the exposed wire ends from the crimp terminal in the terminal crimping process.

The method of the present invention is for crimping terminals having a substantially semi-circular open barrel intended to cover the end of an insulated conductor. The wire end of the conductor is exposed and a pair of wire claws is provided at extremes of the arc of the barrel. The method comprises (1) supplying a terminal to a predetermined crimping position, (2) inserting the wire end of the insulated conductor into the barrel of the terminal while correcting and maintaining its desired position, followed by crimping the crimp terminal.

The apparatus comprises (1) a pressure sustaining element for supporting the barrel of the terminal at a predetermined crimping position, (2) an insulated conductor source for supplying the conductor end to the barrel of the terminal, and (3) a pressure exerting element, cooperating with the sustaining element, for crimping the claws of the terminal to the wire end of the insulated conductor.

The conductor supply device includes a wire clamp for clamping the wire end of the conductor to guide it to the inside of the barrel. In a preferred form of the apparatus, there is an insulation clamp, which grasps the insulation end of the conductor as the wire clamp grips the wire end. The supply device, by movement of the insulation and wire clamps relative to each other, exerts tension on the conductor and thereby straightens it.

It has been found desirable to locate the terminal in a conductor housing, and to provide a housing carrier to convey the housing to the predetermined crimping position. There is a port in the bottom of the housing to permit the pressure sustaining device to enter and bear against the crimp terminal. To position the wire end properly, there is a guide groove through which the wire end is inserted.

The pressure exerting element includes a pressure piece which forces the wire end of the conductor, through the guide groove, into the wire barrel, and between the wire claws. At the same time, it forces the insulation end into the insulation barrel and between the insulation claws. The pressure piece maintains pressure against the conductor and barrel to prevent dislocation thereof. The crimper then presses against the barrel and indirectly against the pressure sustaining element (which advantageously is an anvil) to crimp the claws securely to the wire end and insulation end of the conductor. The pressing piece desirably has two legs, each bearing against one of the wire claws and having a guide face for locating the terminal properly with respect to the crimper and the sustaining element.

Each pressing piece has a guide face on the leading end thereof which corrects the position of the terminal before it is crimped. Preferably, the pieces are proportioned so that they bear against the arc ends of the intermediate portion of the terminal, i.e. between the wire claws and the insulation claws, equally when the terminal is properly located.

In a further variation of the device, a detector is provided which determines the position of the pressure exerting device when it crimps the wire claws. If a wire end has escaped from the crimped claws, it will prevent the exerting device from advancing fully toward the barrel. When this happens, the detector can signal the defect and/or instruct the control to take appropriate action so that the defective conductor is not used.

In operation, the stripped wire end of the insulated conductor is inserted into the barrel of the crimp terminal while the conductor and terminal are brought into proper alignment for crimping. Accordingly, even when the wire end of the conductor is deformed or torn during the stripping or supply processes, the crimping process can go forward and retain all the wire ends securely in the barrel of the crimp terminal.

DETAILED DESCRIPTION OF THE PREFERRED EMBODIMENT

Figure 1:
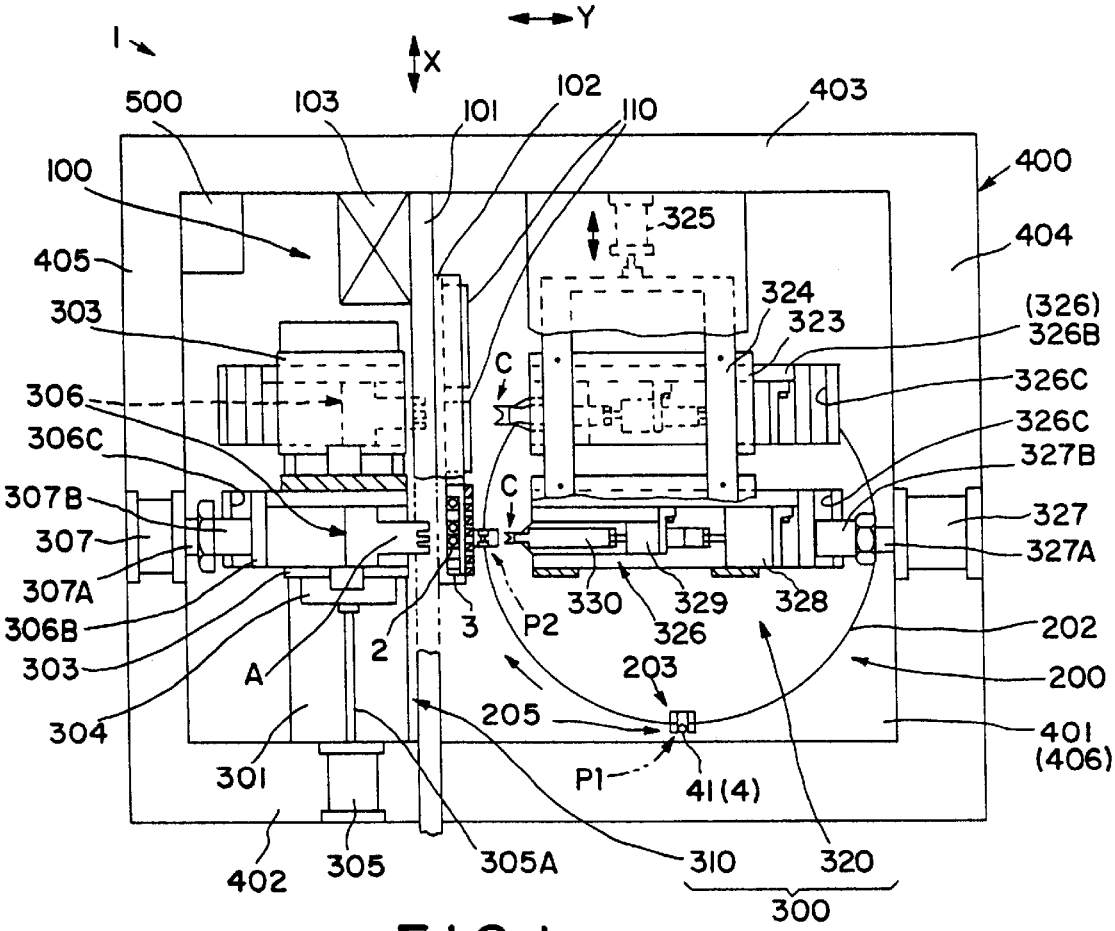
FIG. 1 is a schematic plan view showing a terminal crimping apparatus in accordance with the present Invention.
Figure 2:
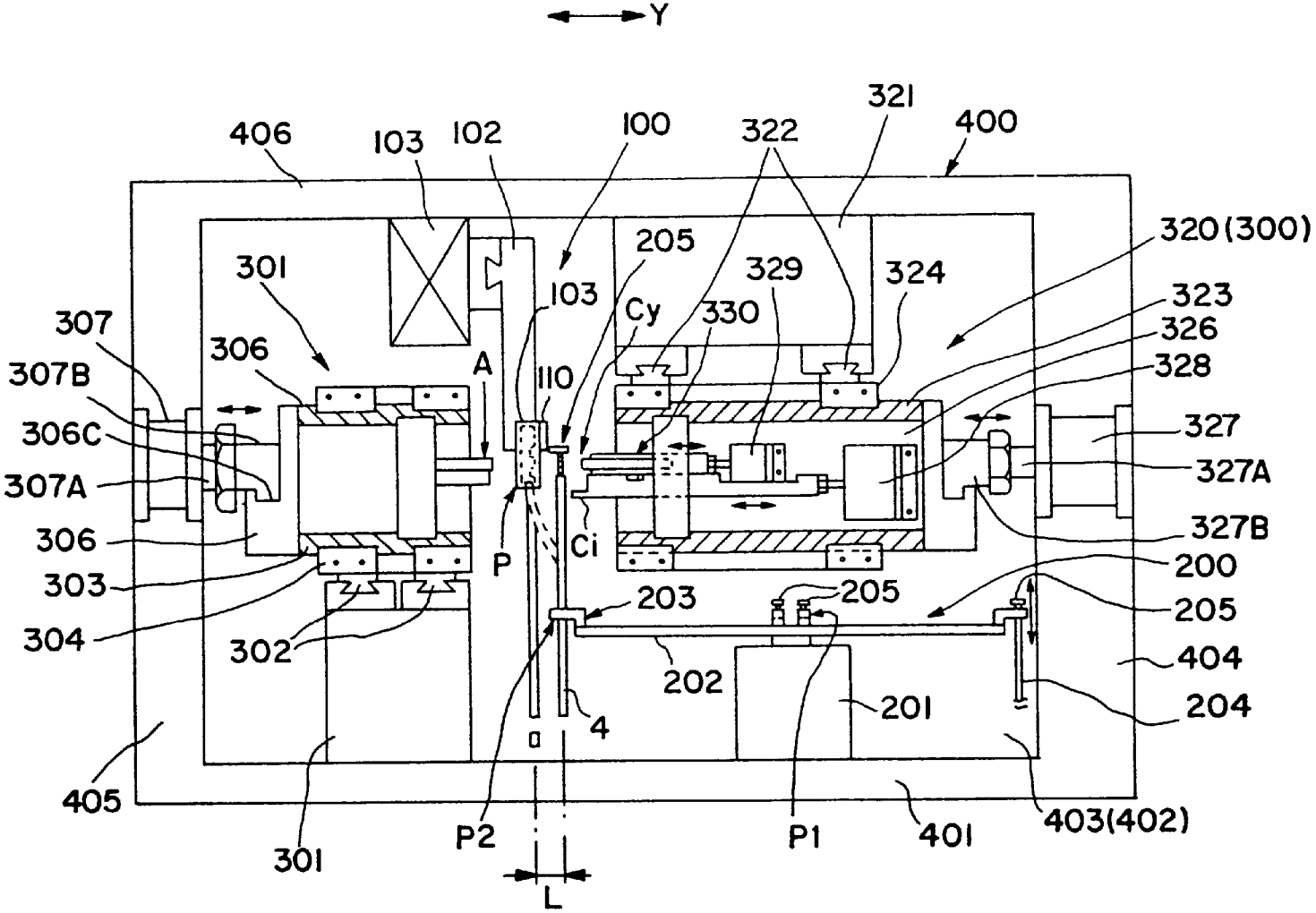
FIG. 2 is a schematic elevation of the terminal crimping apparatus of FIG. 1.

Referring to FIGS. 1 and 2, terminal crimping apparatus 1 comprises, in body 400, housing carrying mechanism 100 for conveying conductor housing 3 containing terminal 2; a conductor supply device 200, for supplying conductor end 41 (including exposed wire end 41A and insulation end 41B) to crimp terminal 2 in conductor housing 3; and crimp mechanism 300 for crimping terminal 2 to end 41 of insulated conductor 4.

Body 400 includes lower frame 401, front frame 402, rear frame 403, right frame 404, left frame 405, and upper frame 406. The direction perpendicular to front frame 402 and rear frame 403 is the X direction, and the horizontal direction perpendicular to right frame 404 and left frame 405 is the Y direction.

Housing carrying mechanism 100 is equipped with carrying rail 101 hung on upper frame 406 and extending along the X direction. Carrying rail 101 includes connector carrying table 102 for carrying conductor housing 3, which is moved reciprocally in the X direction by driving apparatus 103. Conductor housing 3 is carried on carrying table 102 to be supplied to predetermined supply position P2.

Figure 3:
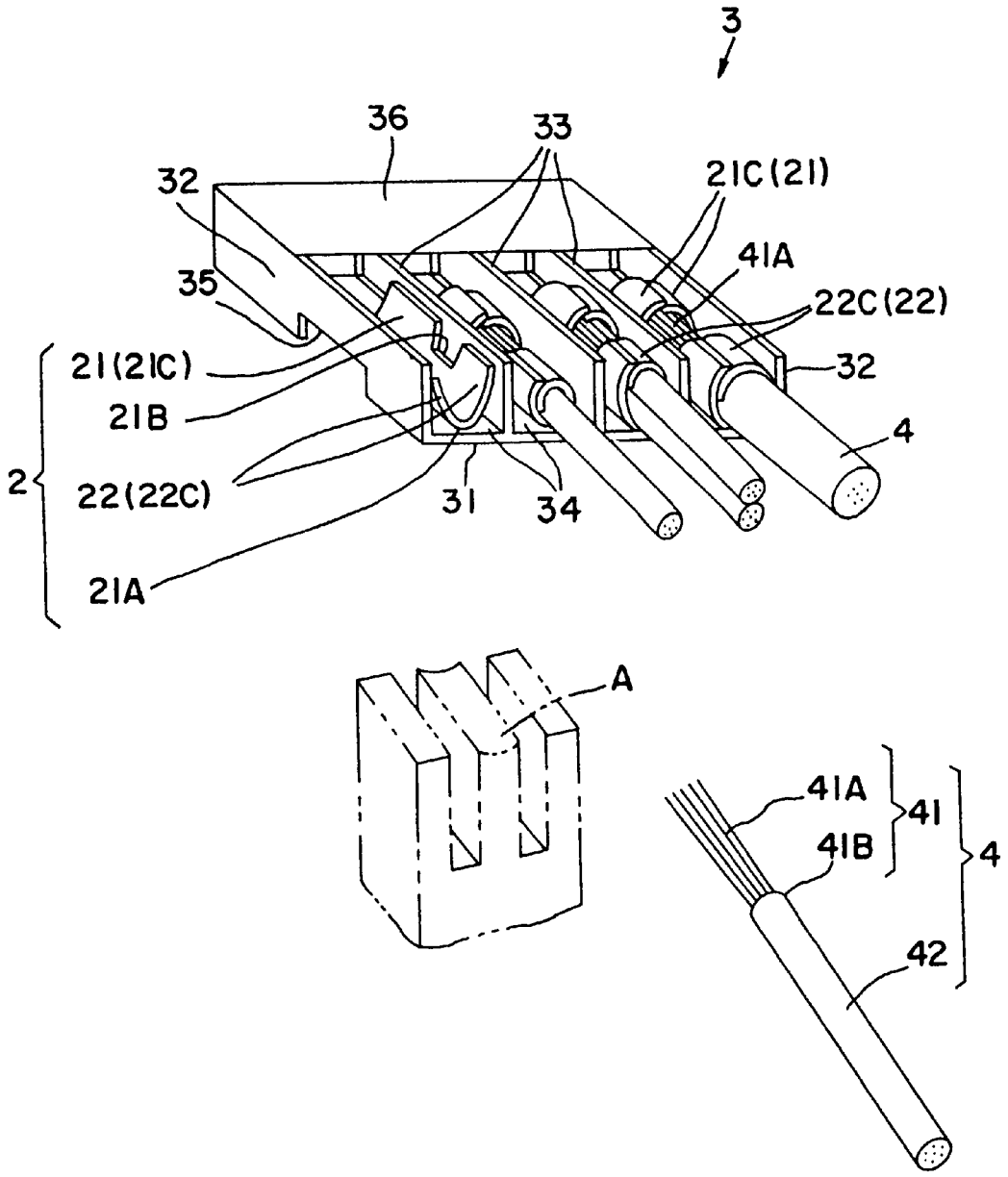
FIG. 3 is a schematic perspective view of the conductor housing containing the terminal to be crimped by the inventive apparatus.

As shown in FIG. 3, conductor housing 3 is a resin molding having integral bottom plate 31, a pair of side plates 32, and a plurality of partition boards 33, parallel to each other and spaced apart between side plates 32, 32, thereby dividing housing 3 into containers 34, each of which contains terminal 2. In bottom plate 31, there is anvil port 35 through which anvil A of crimp mechanism 300 can pass. Terminal 2 comprises wire barrel 21 to be crimped to wire end 41A of insulated conductor 4 and insulation barrel 22 to be crimped to insulation end 41B of conductor 4.

Figure 13:
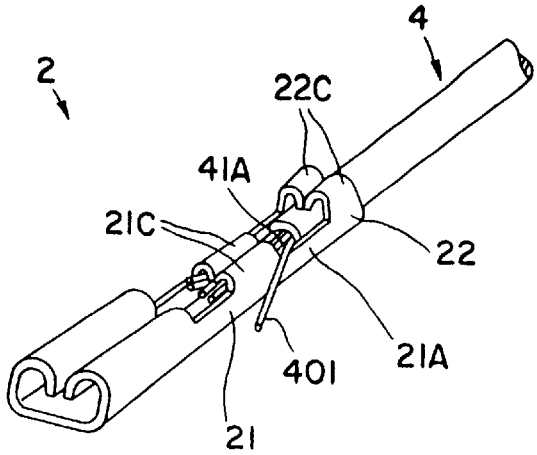
FIG. 13 is a schematic perspective view of a crimp terminal.
Figure 14:
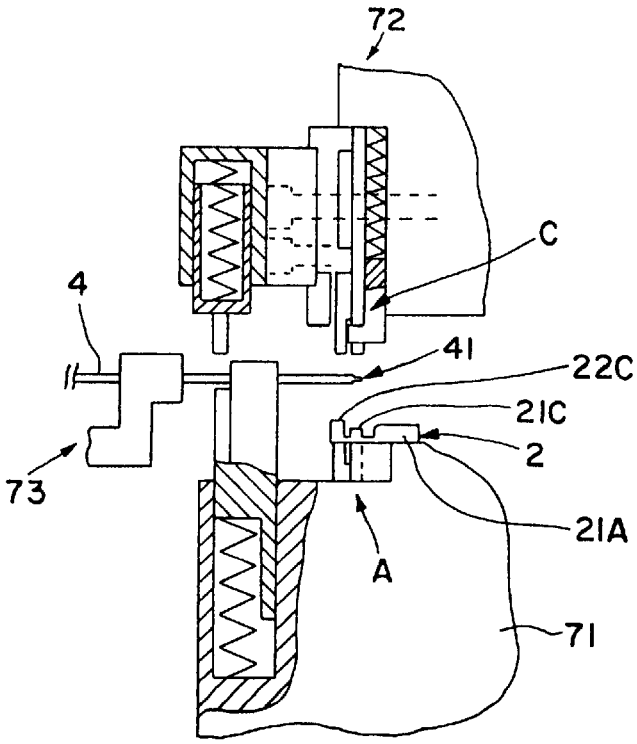
FIG. 14 PRIOR ART
FIG. 14 is a schematic sectional view of a terminal crimping apparatus of the prior art.
Figure 15:
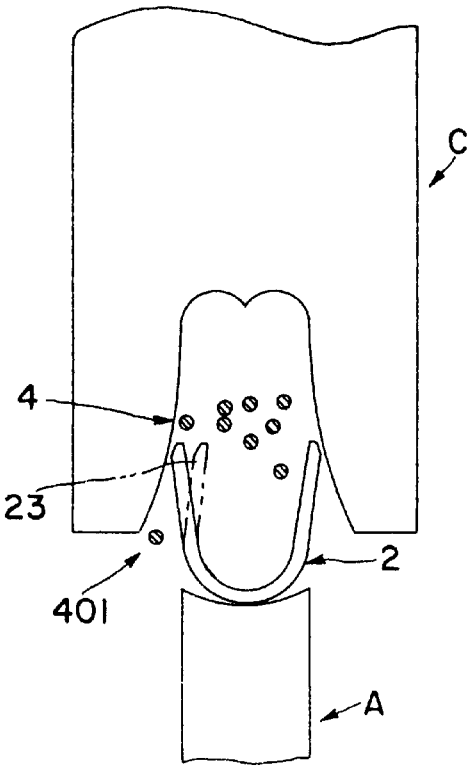
FIG. 15 PRIOR ART
FIG. 15 is an enlarged view of part of the prior art terminal crimping apparatus of FIG. 14.

Wire barrel 21 includes a semi-circular common barrel 21A having arc ends 21B covering conductor end 41, and a pair of wire claws 21C projecting therefrom to be crimped to wire end 41A. Terminal 2 also has insulation barrel 22 with insulation claws 22C which are to be crimped to insulation end 41B. In an open barrel terminal, such as terminal 2, one of wire claws 21C is laid over the other, thereby enhancing crimp reliability. Of course, other types of crimps may also be used, such as the so-called F crimp (see FIG. 13) for wedging the tips of claws 21C, 21C of wire barrel 21 into wire end 41A and bringing them into contact with each other.

To attach terminal 2 to conductor housing 3, the terminal lance system, case lance system, or double stopping system (the lance system plus a retainer) may be used. In case 36 of housing 3, terminal 4 is held by an unillustrated lance on either housing 3 or terminal 4 (in the terminal lance system, the lance is on the crimp terminal and, in the case lance system, the lance is on the housing). Insulated conductor 4 comprises wire end 41A, which is exposed by stripping in the usual manner, and insulated end 41B, which is the end of the insulated portion of conductor 4 adjacent wire end 41A. Together, they form conductor end 41.

Figure 4:
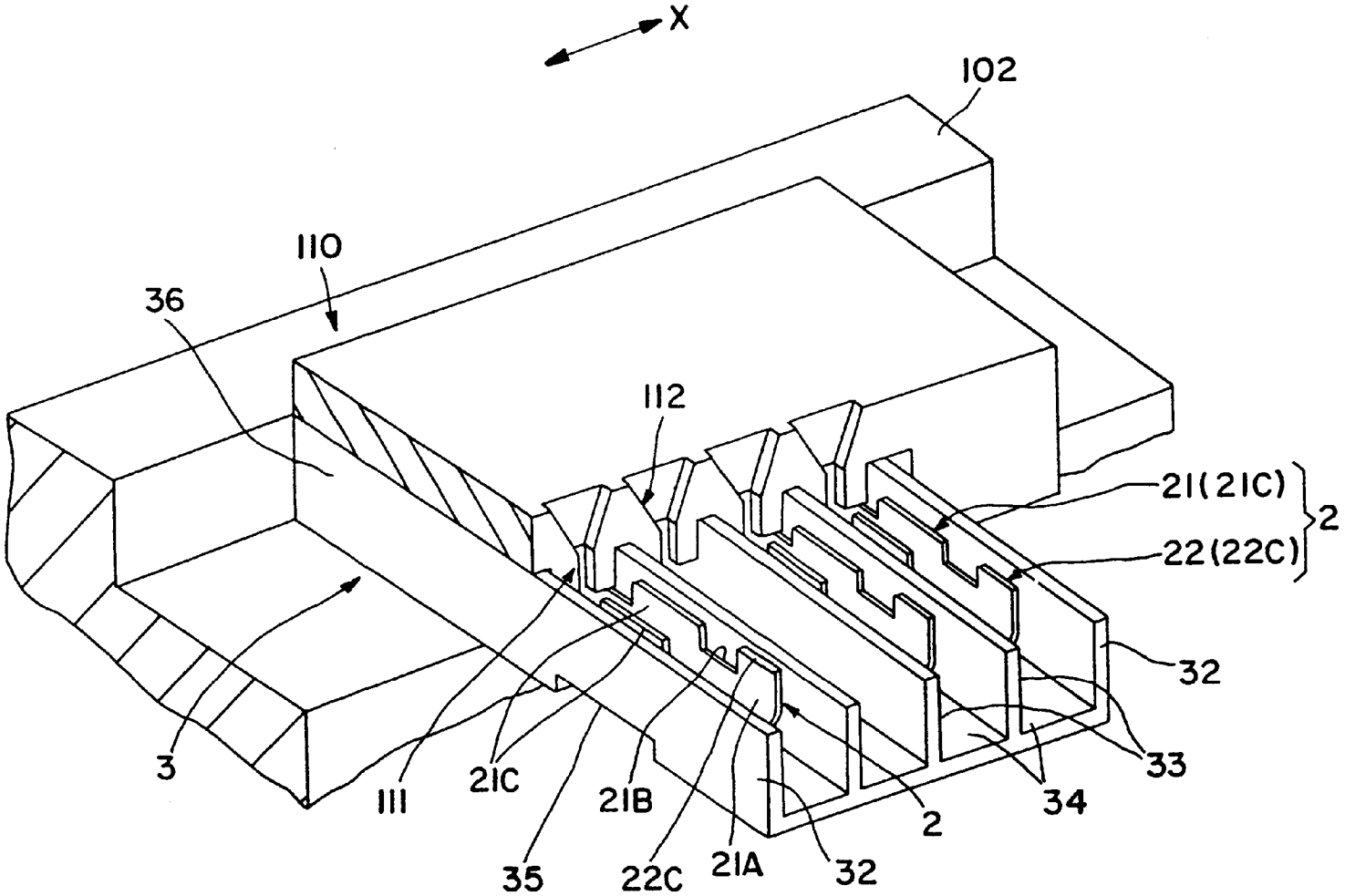
FIG. 4 is a schematic perspective view showing the conductor housing mounted in the supply mechanism.

As shown in FIG. 4, housing 3 is detachably mounted on housing carrier 100 (see FIG. 2) on carrier table 102. Clamp member 110 is fixed to carrier table 102 to accomplish this. With respect to the construction for fixing housing 3 to carrier table 102, clamp member 110 is urged against carrier table 102 in the clamp direction by a tension coil spring or torsion coil spring and opened by a cam to mount or disconnect from housing 3. Alternatively, clamp member 110 may be fixed to table 102 with a bolt.

Clamp member 110 is provided with guide plate 111 to guide conductor 4 as it enters terminal container 34. Guide plate 111 faces the direction from which wire end 41A is introduced in terminal container 34, and has guide groove 112 for guiding wire end 41A to wire barrel 21 of terminal 2. Guide groove 112 is preferably a funnel shape with the side into which wire end 41 is introduced widened.

Referring to FIGS. 1, 2, and 5, conductor supply device 200 comprises pulse motor 201, fixed to lower frame 401 of body 400; turn-table 202, driven for rotation by pulse motor 201; plural pairs of insulation clamps 203, which are disposed at an equal distance circumferentially on turn-table 202 and mounted on the outer periphery of the upper surface thereof; extension shaft 204, disposed above each pair of insulation clamps 203 and passing therethrough; and wire clamp 205, fixed to the upper end of extension shaft 204.

Pulse motor 201 causes intermittent rotation of turn-table 202 in predetermined steps, by which a pair of clamps 203 or 205 is in position P1 to receive conductor 4 and another pair of clamps 203 or 205 supplies the already received covered conductor 4 to crimp mechanism 300 at predetermined supply position P2. Receiving position P1 and supply position P2 are separated in plan view by, for example, 90°. While clamps 203 and 205 are moving from receiving position P1 to supply position P2, extension shaft 204 extends under the influence of a drive member (not shown), whereby wire clamp 205 moves upward relative to insulation clamp 203. Thus, wire end 41A is carried to a position between anvil A and crimper C which are waiting to carry out the crimping process. In this manner, insulation claws 22C are is crimped around insulation end 41B, and wire claws 21C are crimped around wire end 41A.

The distance between insulation clamps 203, 203 can be adjusted by, for example, an unillustrated feed screw passing through the two insulation clamps 203, 203; as a result, they can clamp insulation end 41B of conductor 4. At the same time the distance between insulation clamps 203, 203 is adjusted, the distance between wire clamps 205, 205 is similarly adjusted. Advantageously, the clamping force of insulation clamps 203, 203 is sufficiently smaller than the clamping force of wire clamps 205, 205 so that, when wire clamp 205 moves upward relative to insulation clamp 203, insulated conductor 4 is stretched and hence straightened.

The stripping of conductor 4 can be performed by any known apparatus. Further, by the unillustrated delivery mechanism, insulated conductor 4, stripped to expose wire end 41A at both ends, is delivered to the first pair of clamps 203, 205, after which the next pair of clamps 203, 205 can clamp the other end of insulated conductor 4 at receiving position P1.

Figure 5A:
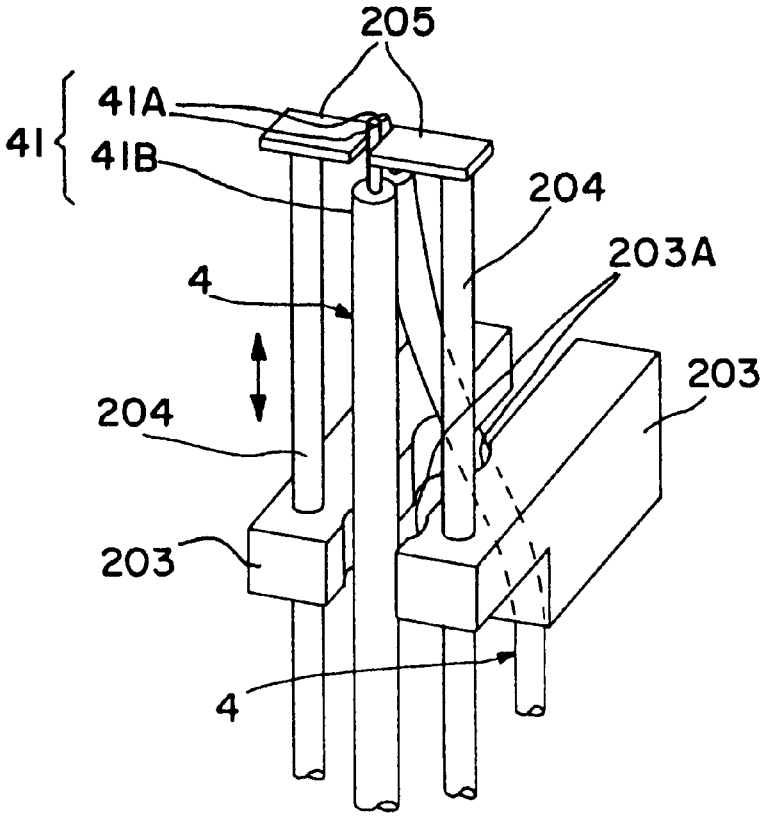
FIG. 5A is a schematic perspective view of the wire and insulation clamps of the terminal crimping apparatus of the invention.
Figure 5B:
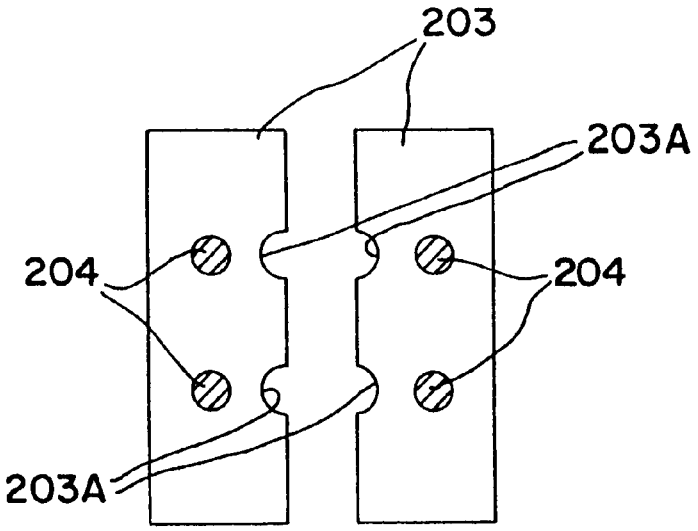
FIG. 5 is a sectional view of the clamps of FIG. 5(A)

In order to supply a plurality of conductors 4 to wire claws 21C of terminal 2, insulation clamp 203 has plural pairs of round faces 203A, as particularly shown in FIG. 5(B). When insulated conductor 4 is a single piece, round face 203A positioned radially outwardly clamps the conductor. Alternatively, in case of a plurality of conductors 4, they are guided to corresponding round faces 203A, by a non-illustrated jig, and wire ends 41A of insulated conductors 4 are bundled and, as shown in FIG. 5(A), insulation parts 42 are clamped at each round face 203A, and respective wire ends 41A are clamped together by wire clamp 205.

Crimp mechanism 300 comprises pressure sustaining element 310, to receive pressure from terminal 2 in housing 3 at crimp position P, and pressure exerting element 320, to exert pressure on crimp terminal 2 and conductor end 41. Pressure sustaining element 310 and pressure exerting element 320, holding carrying rail 101 of the housing carrier 100 therebetween, are opposite each other and move in the Y direction.

Figure 6:
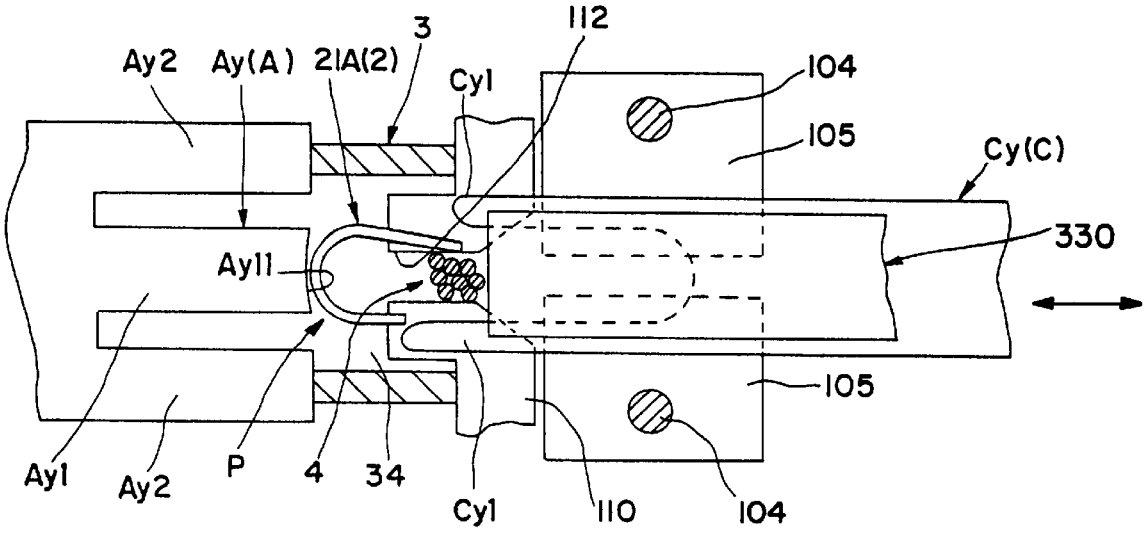
FIG. 6 is a bottom view of the essential part of the crimping mechanism of the invention.
Figure 7B:
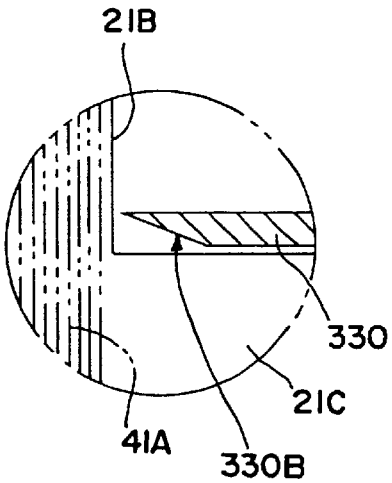
FIG. 7 is a sectional elevation of the device of FIG. 6.
Figure 7A:
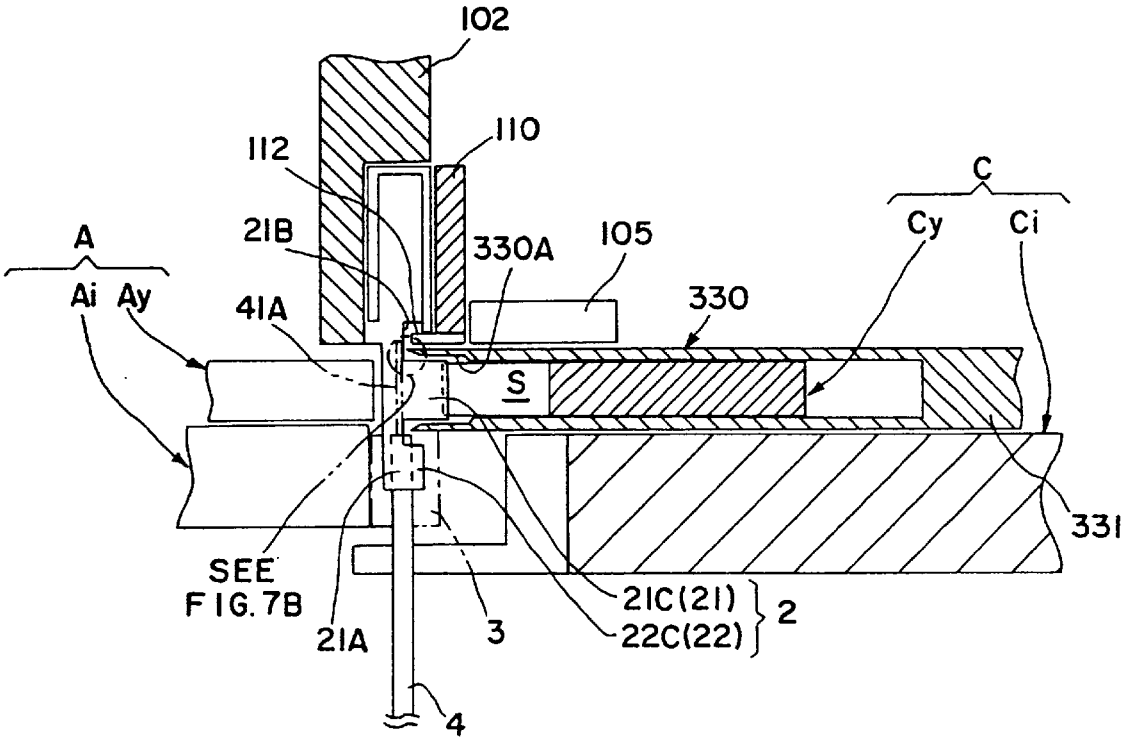

FIG. 6 is a bottom view of the essential part of crimp mechanism 300 and FIG. 7 is a sectional view thereof. Pressure sustaining element 310 is provided with anvil A and pressure exerting element 320 has crimper C; these two elements cooperate to crimp terminal 2 to conductor end 41 of conductor 4 therebetween. As shown in FIGS. 6 and 7, anvil A comprises wire anvil Ay to receive wire barrel 21 and wire end 41A and insulation anvil Ai to receive insulation barrel 22 and insulation end 41B. Crimper C includes wire crimper Cy for crimping claws 21C of wire barrel 21 in cooperation with anvil Ay and insulation crimper Ci for crimping claws 22C of insulation barrel 22 in cooperation with anvil Ai.

Wire crimper Cy comprises a member having legs Cy1 and anvil body Ay1 of wire anvil Ay. Anvil body Ay1 of anvil Ay carries pressure sustaining face Ay11 which is in close contact with the outer peripheral surface of terminal 2 during the crimping operation to receive the load from wire crimper Cy. On both sides of anvil body Ay1, a pair of retainers Ay2 are integrally formed; thus, anvil A has the shape of the letter E. Legs Cy1 are prevented from spreading by being clamped between anvil body Ay1 and retainers Ay2.

Referring to FIG. 7, insulation crimper Ci is formed with two legs in substantially the same shape as that of crimper Cy. It crimps insulation claws 22C of insulation barrel 22 to insulation end 41B. Insulation anvil Ai is rectangular, and sustains the load of insulation crimper Ci by coming into close contact with terminal 2 through part 35 during crimping.

Referring more particularly to FIGS. 1 and 2, pressure sustaining element 310 includes slide table 301 fixed to lower frame 401 of body 400. On slide table 301, a pair of guide rails 302 extending in the direction X are fixed. On the guide rails 302, a plurality of block cases 303 (only two cases are illustrated in FIG. 1) are reciprocally movable on guide rails 302 in the X direction. Block cases 303 are integrally connected by connecting frame 304 along the direction X and separated from each other by a predetermined distance. Connecting frame 304 is driven in the direction by rod 305A of pressure cylinder 305 mounted on front frame 402 of body 400.

With respect to each block case 303, anvil unit 306 of an individually different kind is reciprocally movable in the Y direction. Anvil unit 306 comprises integral anvil A opposite terminal 2 in housing 3 which is carried to crimp position P by housing carrier 100. Block part 306B carries anvil A, and joint part 306C is formed on the side opposite anvil A.

Anvil unit 306 in each block case 303 is driven in the Y direction by rod 307A of pressure cylinder 307 which is connected through joint part 306C. Joint part 306C and joint 307B, fixed to rod 307A, are in channel form and are mutually engageable and detachable in the X direction. By connecting desired anvil unit 306 to pressure cylinder 307, anvil A can be advanced and retracted in the direction Y.

Pressure exerting element 320 is equipped with slide table 321 fixed to upper frame 406 of body 400. On slide table 321, a pair of guide rails 322, extending in the X direction, are mounted. To the lower part of guide rails 322, there is connected a plurality of block cases 323 (only two cases are illustrated in FIG. 1), and they are reciprocally movable along the direction X on guide rails 322. Each block case 323 is integrally connected to connection frame 324, separated by a predetermined distance in the X direction. Connection frame 324 is driven in the X direction by a rod extending axially from pressure cylinder 325 mounted on rear frame 403 of body 400.

In each block case 323, crimper unit 326 is accommodated in reciprocally movable manner in the Y direction. Each crimper unit 326 has crimper C integral therewith facing terminal 2 in housing 3 which is carried to crimp position P by carrier 100. Block part 326B, carrying crimper C, and joint 326C similar to joint 306C, are on the opposite side of block part 326B from crimper C. Crimper unit 326 is driven in the Y direction in the same manner as pressure sustaining element 310 by rod 327A of pressure cylinder 327 which is connected through joint 326C.

Referring to FIG. 7, pressing pieces 330 are provided on the top and bottom of wire crimper Cy, and their bases are connected to the axially extending rod of pressure cylinder 329 through the connection part 331. Pressure cylinder 329 is mounted on block part 326B which carries crimper C. Accordingly, pressing pieces 330 are displaceable in the Y direction relative to crimper Cy. At the front end of each pressing piece 330 there is shoulder 330A which can clamp wire claw 21C of terminal 2, and chamfer ends 330B guide each wire claw 21C into clamp space S. Pressure cylinder 307 of pressure sustaining element 310 and pressure cylinder 327 of pressure exerting element 320 are aligned with each other along a horizontal line passing through supply position P2 and crimp position P.

On body 400 of crimping apparatus 1, there is additionally provided control 500 to control the operation sequence of the apparatus. In operation, housing 3, carried by housing carrier 100 is conveyed on carrier table 102 in the X direction. Terminals 2, in housing 3, are sequentially carried to position P between anvil A and crimper C. Insulated conductor 4, with wire end 41A stripped by any known method is carried to conductor supply device 200. Conductor 4 is received by each clamp 203, 205 at receiving position P1 shown and clamped (see FIG. 1).

When each clamp 203, 205 carrying insulated conductor 4 reaches supply position P2 (as shown in FIG. 1), shaft 204 is extended by the action of a drive member (not shown). Thus, wire clamp 205 is displaced upward relative to the insulation clamp 203 to carry wire end 41A to a position between anvil Ay and crimper Cy which are waiting to carry out the crimping process. Thus, insulated end 41B of conductor 4 is supplied to the space between anvil Ai and crimper Ci. Because shaft 204 extends as described, two clamps 203, 205 cooperate to stretch insulated conductor 4 vertically, thereby straightening it.

Crimp mechanism 300 selects anvil A or crimper C in parallel with the carrying operation of housing 3 or the supply operation of covered conductor 4, respectively. Pressure sustaining element 310 of crimp mechanism 300 and each of cylinders 305 and 325 are operated to drive block cases 303, 323 in the X direction to crimp position P. Also, anvil unit 306 and crimper unit 326 are connected to their corresponding pressure cylinders 307, 327 and mutually moved in the Y direction to permit crimping of terminal 2 to conductor 4. Then, crimping mechanism 300 actuates each of pressure cylinders 307, 327, 328, and 332 to carry out the crimping process.

Figure 8A:
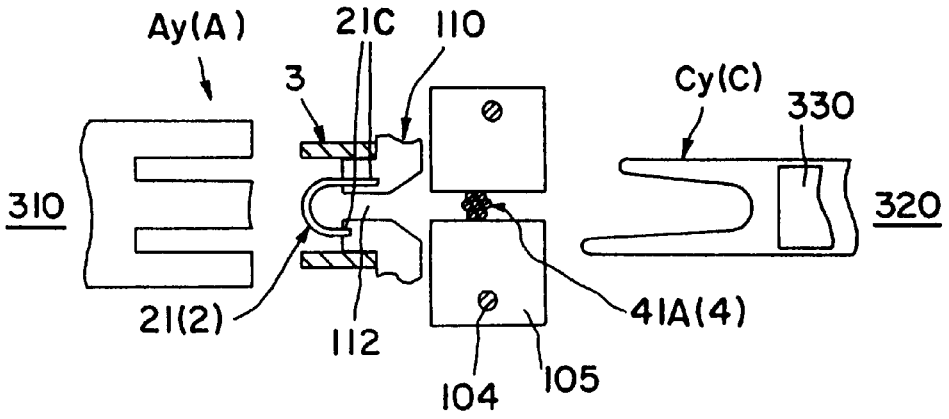
FIGS. 8(A) to 8(C) are the first stages of the operation of to of the crimping mechanism.
Figure 8B:
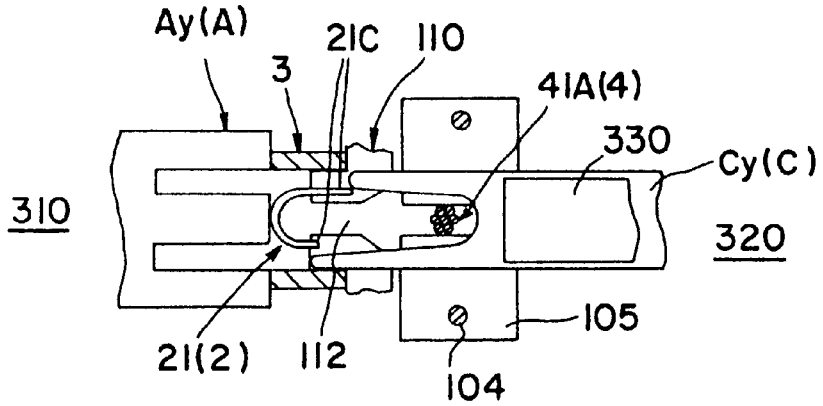
Figure 8C:
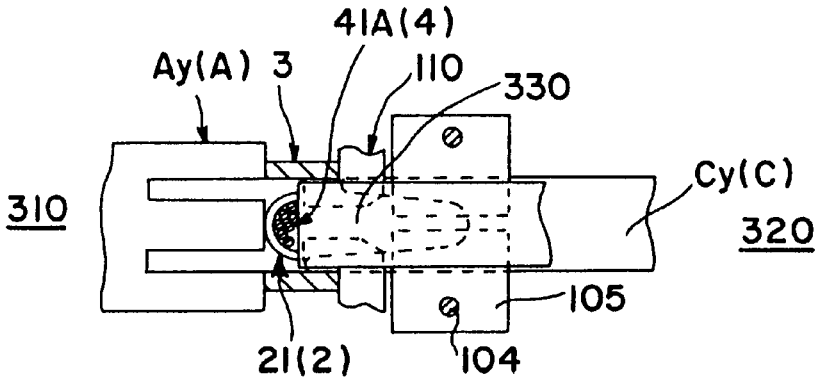
Figure 9D:
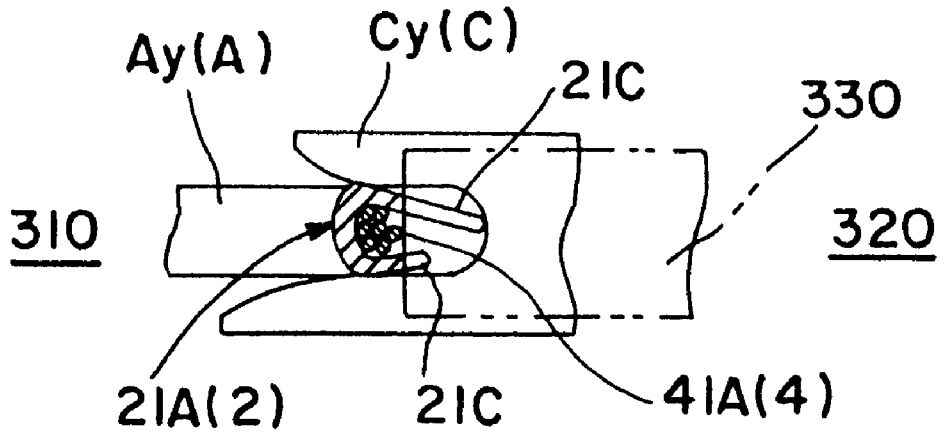
FIGS. 9(D) and 9(E) are similar to FIGS. 8 showing further steps and in the operation of the crimping mechanism.
Figure 9E:
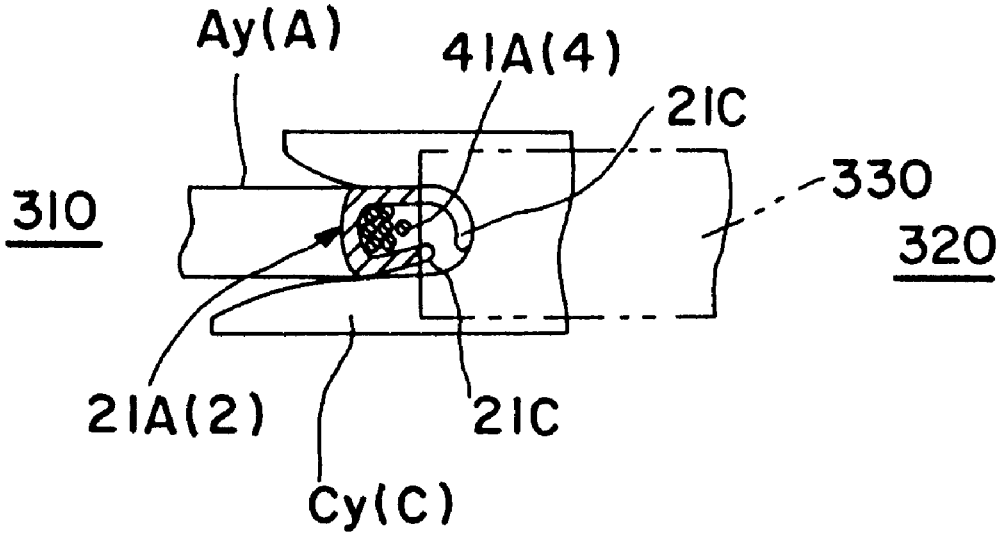
Figure 10F:
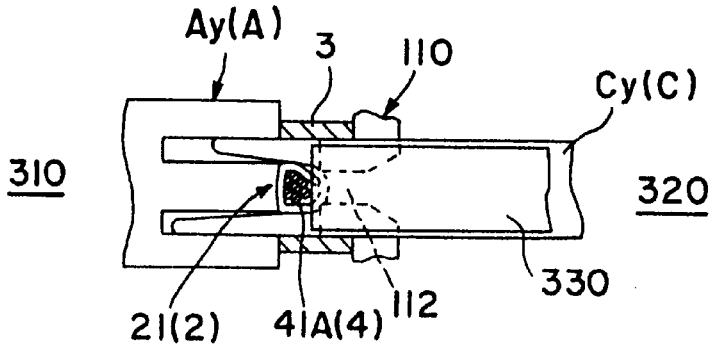
FIGS. 10(F) to 10(H) are similar to FIGS. 9 showing the final steps to in the operation of the crimping mechanism.
Figure 10G:
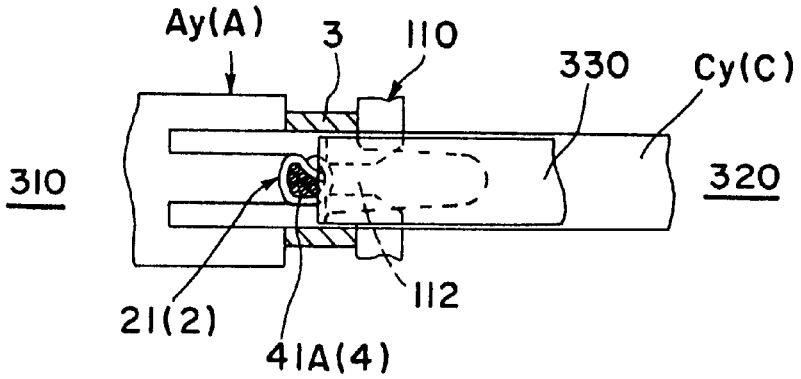

The operation of crimping mechanism 300 is shown in FIGS. 8, 9, and 10. The crimping process is started with the mechanism in the position shown in FIG. 8(A). Pressure sustaining element 310 and pressure exerting element 320 operate synchronously to bring anvil unit 306 and crimper unit 326 to conductor end 41. At this time, pressure pieces 330 of pressure exerting element 320 bring wire end 41A, held by wire clamp 205, toward anvil Ay, simultaneously with the approach of crimper Cy.

As shown in FIG. 8(B), when crimper Cy starts to engage claws 21C, pressure cylinder 329 (see FIG. 1) extends rod 329A to project pressure pieces 330 and, prior to the approach of wire crimper Cy to anvil Ay, inserts wire end 41A between claws 21C, as shown in FIG. 8(C). Pressure pieces 330 urge conductor end 41 into terminal 2 by the force of pressure cylinder 329 and, prior to the start of the crimping process, hold conductor end 41 and terminal 2 against anvil Ay. Clamp member 110, holding housing 3 on carrier table 102, is equipped with guide groove 112, so that wire end 41A is forced into wire barrel 21 of terminal 2 through guide groove 112.

Thereafter, as shown in FIG. 7, pressure pieces 330 contact two curved arc ends 21B of terminal 2 and press wire barrel 21 against anvil A. Terminal 2 is clamped so that three points comprising two curved arc ends 21B and the outer peripheral surface of wire barrel 21 are fixed to pressure pieces 330 and/or anvil A. As a result, due to the balancing of the f orces between one arc end 21B and one of the pressure pieces 330, and between the other arc end 21B and the other of the pressure pieces 330, circumferential displacement of terminal 2 is minimized and it is circumferentially retained in the proper crimping position P. Moreover, chamfer ends 330B on pressing pieces 330 introduce claws 21C of wire barrel 21 into clamp space S. Thus, displacement of terminal 2 in the longitudinal direction is corrected by each claw 21C, and terminal 2 is longitudinally fixed in the proper crimping position P.

After projection of pressure pieces into contact with wire end 41 and terminal 330, they are in the position shown in FIG. 8 (C); they continue to press against wire end 41A exclusively under the force exerted by pressure cylinder 329, a force weaker than that of crimper C. Pressure cylinder 328 of insulation crimper Ci is actuated, and insulation crimper Ci for insulation end 41B crimps insulation barrel 22 around insulation end 41B. Next, pressure cylinder 307 and pressure cylinder 327 exert their forces on units 306 and 326 in the X direction, and terminal 2 is crimped between anvil Ay and crimper Cy, as shown in FIG. 9.

Thus, terminal 2 is held against anvil Ay throughout primping so that pressure pieces 330 prevent displacements of position in both the circumferential and longitudinal directions. Accordingly, definite overlap crimping can be applied to terminal 2, even for fine cables, as shown in FIG. 9(E).

Figure 10H:
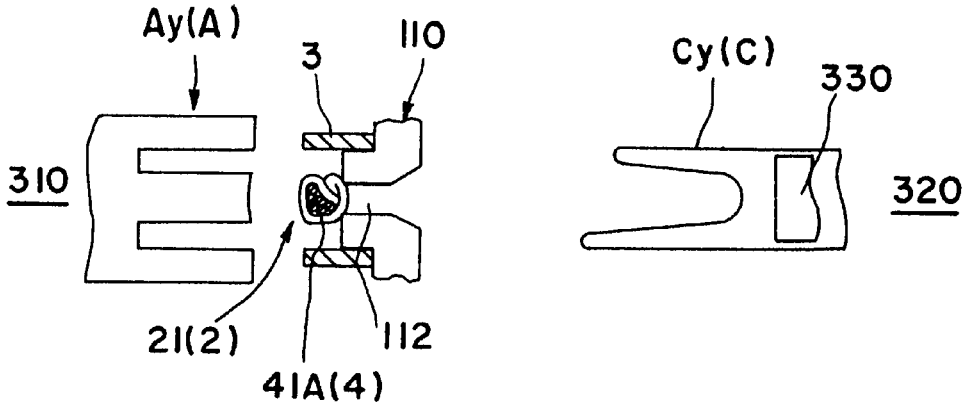

Referring to FIGS. 10, when the crimping process has been completed and the crimper reaches its lower dead point, pressure cylinders 327, 328 of pressure part 320 are first operated to allow wire crimper Cy and insulation crimper Ci to retreat from wire anvil Ay and insulation anvil Ai, respectively. However, pressure cylinder 329 continues to exert force through pressure pieces 330 to maintain terminal 2 in its position. As a result, crimper C is affirmatively and reliably separated from terminal 2. Thereafter, pressure cylinder 307 and pressure cylinder 329 withdraw rods 307A and 329A, respectively, and each member is returned to its starting position to await the next crimping cycle as shown in FIG. 10(H).

Figure 11:
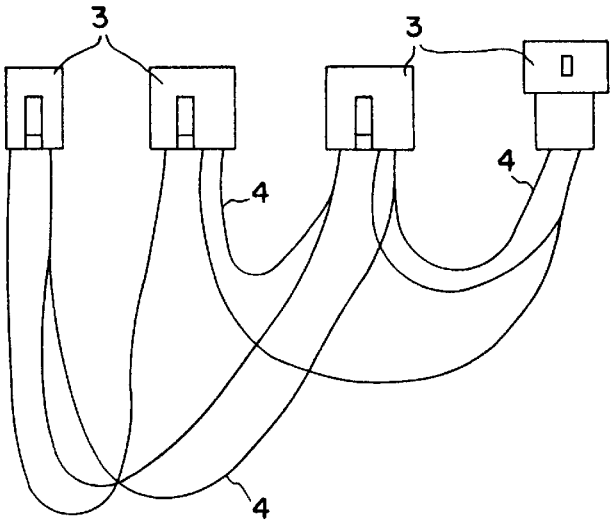
FIG. 11 is a schematic view of a wire harness produced by the apparatus of the invention.

Conductor 4, which has been crimped is suspended in U-shape on housing carrier 100 through housing 3. In this case, to prevent suspended conductor 4 from interfering with the uncrimped conductors, crimping position P is separated by distance L in the Y direction from supply position P1. By repeating the processes, it is possible to manufacture wire harnesses having a sophisticated wiring style as shown in FIG. 11, which is a schematic view of a wire harness which can be manufactured by terminal crimping apparatus 1.

Terminal 2 is supplied to crimp position P, and conductor end 41 of insulated conductor 4 is inserted into terminal 2 while correcting it to the desired supplied position. Accordingly, even if wire end 41A is deformed or frayed in the stripping or supply processes, because the causes of such defects are eliminated in the crimp process, all wire ends 41A are reliably accommodated in wire barrel 21A of terminal 2.

Further, terminal 2 is pressed into proper crimping position by pressure pieces 330; thereafter, crimping is carried out. Therefore, defects resulting from position displacement or position defect of terminal 2 can be prevented with certainty.

Figure 16A:
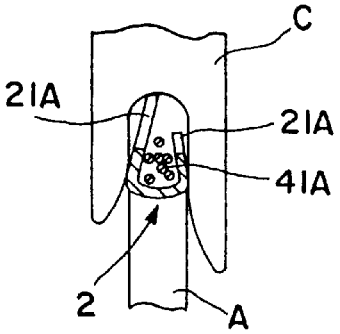
FIG. 16A PRIOR ART
FIGS. 16(A) and 16(B) are enlarged fragmentary schematic views of prior art apparatus showing some of the problems which arise with conventional constructions.
Figure 16B:
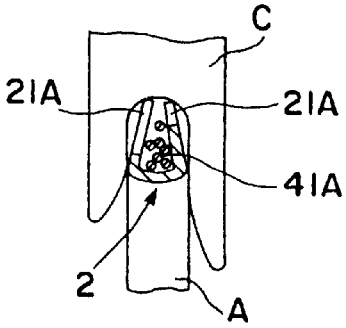
FIG. 16B PRIOR ART

Wire end 41A is affirmatively carried to terminal 2 without being affected by deformation of wire end 41A. In addition, as wire end 41A itself is clamped, it becomes possible to prevent multiple wire ends 41A from being separated from one another, as shown in FIGS. 16. Moreover, clamps 203, 205 of conductor supply device 200 are capable of stretching insulated conductor 4 so that crimping defects resulting from bends can be avoided.

In addition, wire end 41A is led to the proper location inside of wire barrel 21C by guide groove 112 of the clamp member 110. Accordingly, exclusion of any wire ends 41A can be definitely inhibited. This maintains the integrity of wire ends 41A, even though the pressure of crimper unit 326 tends to cause spreading thereof.

Figure 12:
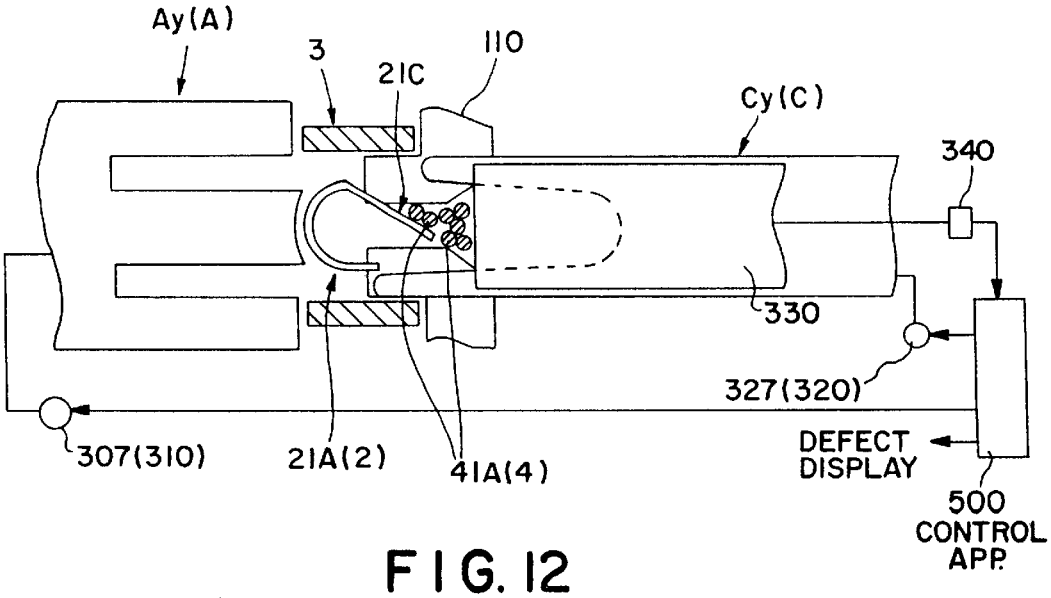
FIG. 12 is a bottom view of a modification of the crimping mechanism.

If, as shown in FIG. 12, wire claws 21C of terminal 2 are extremely deformed so as to close the barrel, wire ends 41 of insulated conductor 4 may be outside of deformed claws 21C when terminal 2 is crimped; as a result, in spite of the various improvements of the present Invention, wire ends 41 cannot be fitted into the barrel. In such an extreme case, to prevent terminal 2 having a crimping defect from flowing to subsequent processes, additional mechanisms are provided.

To connecting part 331, displacement detector 340 is mounted, including reset switches, optical sensors, etc. Based on the output signal thereof, detector 340 can compare the displacement of pressing piece 330 with a previously input normal displacement. When a wire end 41A is excluded from terminal 2, pressing pieces 330 are in direct contact therewith, and further displacement is prevented. Detector 340 recognizes the difference and signals control apparatus 500 accordingly. Control apparatus 500 can stop the operation of pressure sustaining element 310 and pressure exerting element 320 while indicating the defect to the operator.

The foregoing paragraphs show only the exemplifications of the preferred embodiments of the present Invention, and the present Invention is not to be limited except by the character of the claims appended hereto.

What we claim is:

1. An apparatus for crimping a terminal to an insulated conductor, said conductor comprising a conductive core surrounded by an insulation layer and having a wire end, wherein said core is exposed, and an insulation end adjacent said wire end, wherein said core is surrounded by said insulation layer, said terminal in a terminal container comprising a hollow common barrel of substantially arcuate cross section, said common barrel comprising a pair of wire claws, facing each other and extending from opposite ends of said cross section, a pair of insulating claws, facing each other and extending from opposite ends of said cross section, said wire barrel and said insulation barrel being spaced apart axially with a central hollow section therebetween, said central section being substantially arcuate in cross section, extending from opposite ends of said cross section, and terminating in a pair of arc ends, an inserting mechanism comprising a crimping mechanism and a pressure piece, said pressure piece adapted for a retaining movement from a release position, out of contact with said wire end, to a retaining position urging said wire end between said wire claws, said crimping mechanism comprising a pressure sustaining element and a pressure exerting element, said pressure exerting element adapted for a crimping movement from an inoperative position, out of contact with said wire claws, to a crimping position, exerting pressure on said wire claws to cause crimping thereof, a supply device for inserting said wire end into said common barrel between said wire claws, said crimping mechanism adapted to receive said terminal and said wire end between said pressure sustaining element and said pressure exerting element, said sustaining element and said exerting element adapted to crimp said claws therebetween to secure said terminal to said insulated wire and establish electrical contact therewith, said retaining movement taking place before said crimping movement, thereby holding said wire end between said wire claws during crimping, a guide groove at a wall of said container adjacent said wire end, whereby said wire end is guided by said guide groove into said terminal for crimping.

2. The apparatus of claim 1 wherein said guide groove tapers in a direction toward said terminal.

* * * * *